US008322018B2

(12) United States Patent
Liou et al.

(10) Patent No.: US 8,322,018 B2
(45) Date of Patent: Dec. 4, 2012

(54) METHOD OF MANUFACTURING SPEAKER

(75) Inventors: Chang-Ho Liou, Changhua County (TW); Wei-Chung Lee, Taichung (TW); Ming-Daw Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 139 days.

(21) Appl. No.: 12/717,956

(22) Filed: Mar. 5, 2010

(65) Prior Publication Data

US 2011/0146056 A1 Jun. 23, 2011

(30) Foreign Application Priority Data

Dec. 23, 2009 (TW) ..... 98144545 A

(51) Int. Cl.
*H04R 31/00* (2006.01)

(52) U.S. Cl. ..... 29/594; 29/592.1; 381/120

(58) Field of Classification Search ..... 29/592.1, 29/594; 381/150, 345, 351, 385; 382/386
See application file for complete search history.

(56) References Cited

U.S. PATENT DOCUMENTS

| | | | | |
|---|---|---|---|---|
| 3,646,280 | A * | 2/1972 | Tamura et al. | 381/191 |
| 3,894,199 | A | 7/1975 | Tamura et al. | |
| 3,942,029 | A * | 3/1976 | Kawakami et al. | 307/400 |
| 7,246,425 | B2 * | 7/2007 | Mitani | 29/594 |
| 7,877,856 | B2 * | 2/2011 | Fukuyama et al. | 29/594 |
| 2010/0024198 | A1 * | 2/2010 | Chen et al. | 29/594 |

* cited by examiner

*Primary Examiner* — Minh Trinh
(74) *Attorney, Agent, or Firm* — Jianq Chyun IP Office

(57) ABSTRACT

The disclosure is related to a method and a device of manufacturing a speaker. First, a roll element is fabricated by a roll-based manufacturing process and by using a material feeder, and the roll element is cut into many sheet elements by using a cutter. An inserting device is used to insert the sheet elements into a temporary storage device, and an extracting device is used to extract the sheet elements from the temporary storage device and place the sheet elements on another roll element fabricated by another roll-based manufacturing process and by using another material feeder. The sheet elements and the other roll element are combined. The roll elements and sheet elements may be vibrating membranes and porous electrodes of a flat speaker.

17 Claims, 19 Drawing Sheets

METHOD OF MANUFACTURING SPEAKER

CROSS-REFERENCE TO RELATED APPLICATION

This application claims the priority benefit of Taiwan application serial no. 98144545, filed on Dec. 23, 2009. The entirety of the above-mentioned patent application is hereby incorporated by reference herein and made a part of specification.

BACKGROUND OF THE INVENTION

1. Technical Field

The disclosure relates to a method and a device of manufacturing a speaker according to a sheet to roll manufacturing process.

2. Background

Vision and hearing are two humanity's most direct sensory responses. Therefore, scientists have been dedicated to develop various renewable visual and auditory related systems. Regarding the speakers, moving coil speakers dominate the entire market. In recent years, with people's increasing demands for sensing quality, and development trends of 3C products (computer, communication, consumer electronics) for lightness, slimness, shortness and smallness, a power-saving, light and slim speaker designed according to an ergonomic requirement is developed. Such speaker can be used in either large-size flat speakers or small walkman headphones and stereo mobile phones, and in a foreseeable future, such technology may have a plenty of demands and application development.

Presently, electroacoustic speakers are mainly grouped into direct and indirect radiation speakers, and according to driving methods thereof, the speakers are approximately grouped into moving coil, piezoelectric and electrostatic speakers. The moving-coil speaker is widely used, and a technique thereof is relatively mature. However, due to its innate structural defect, a shape of the moving coil speaker cannot be flatized, so that it is not suitable for applying to 3C products and home theatres having development trends of smallness and flatness.

In the piezoelectric speaker, according to a piezoelectric effect of a piezoelectric material, an electric field is applied to the piezoelectric material to cause deformation, so as to drive a vibrating membrane to generate sound. Although such speaker has a flat and miniaturized structure, its sound quality is limited.

Main products of the electrostatic speaker in the market include hi-end earphones and loudspeakers. A functional principle of the conventional electrostatic speaker is to use two fixed porous electrode plates to clamp a conductive vibrating membrane to form a capacitor, and by supplying a direct current (DC) bias to the vibrating membrane and supplying an alternating current (AC) voltage to the two fixed electrodes, the conductive vibrating membrane is vibrated due to an electrostatic force generated under a positive and a negative electric fields, so as to radiate a sound. The bias of the conventional electrostatic speaker has to reach hundreds to thousands voltages, so that an external amplifier with a high price and a great size has to be applied, and therefore application thereof cannot be widespread.

Presently, manufacturing of the speaker still applies a design and producing method of a single unit, for example, a speaker disclosed by a U.S. Pat. No. 3,894,199.

Regarding the electrostatic speaker, the U.S. Pat. No. 3,894,199 discloses an electroacoustic transducer structure.

Referring to FIG. 1, FIG. 1 is a schematic diagram illustrating a conventional speaker unit. The speaker unit includes two fixed electrodes 110 and 120 disposed at two sides. The fixed electrodes 110 and 120 have a plurality of holes for dispersing the generated sound. A vibrating membrane 130 is disposed between the fixed electrodes 110 and 120. The fixing structure 140 is made of an insulation material, and is used for fixing the fixed electrodes 110 and 120 and the vibrating membrane 130. The fixed electrodes 110 and 120 are respectively coupled to an AC voltage source 160 through a transformer 150. When an AC signal is transmitted to the fixed electrodes 110 and 120, potentials of the AC signal are alternately changed, so that the vibrating membrane 130 is vibrated due to a potential difference of both sides, so as to generate a corresponding sound. However, according to the above configurations, a sound pressure output is required to be enhanced, so that an additional power device is used for driving. Therefore, not only the device size is huge, but also relatively more devices are used, and a cost thereof is relatively high. Moreover, since the fixing structure 140 has to fix the fixed electrodes 110 and 120 and the vibrating membrane 130, flexibility of the electroacoustic transducer structure cannot be achieved.

In addition, according to the conventional techniques, during a mass production, individual units have to be produced one-by-one, and the speaker generally has a fixed size or shape, so that effective mass production and cost reduction cannot be achieved, and features of softness, thinness, low driving voltage and flexibility of the speaker cannot be achieved.

SUMMARY

A method for manufacturing a speaker is introduced. In the method, a porous electrode and a vibrating membrane are provided, and a conductive layer is formed on the vibrating membrane. A plurality of supporters is formed on one of the porous electrode and the vibrating membrane. In the method, roll-based materials are used to provide the vibrating membrane and the porous electrode, and a roll vibrating membrane or a roll porous electrode is cut into sheet vibrating membranes or sheet porous electrodes. Then, an inserting device is used to insert the sheet vibrating membranes or the sheet porous electrodes into a temporary storage device, and an extracting device is used to extract the sheet vibrating membranes or the sheet porous electrodes from the temporary storage device. Then, the sheet vibrating membranes or the sheet porous electrodes are placed on another roll vibrating membrane or a roll porous electrode manufactured by another roll-based manufacturing process, and the sheet vibrating membranes or the sheet porous electrodes are combined to the roll vibrating membrane or the roll porous electrode, so as to form a speaker structure.

BRIEF DESCRIPTION OF THE DRAWINGS

The accompanying drawings are included to provide a further understanding of the embodiment, and are incorporated in and constitute a part of this specification. The drawings illustrate embodiments and, together with the description, serve to explain the principles of the embodiment.

DESCRIPTION OF THE EMBODIMENTS

Figure 1:
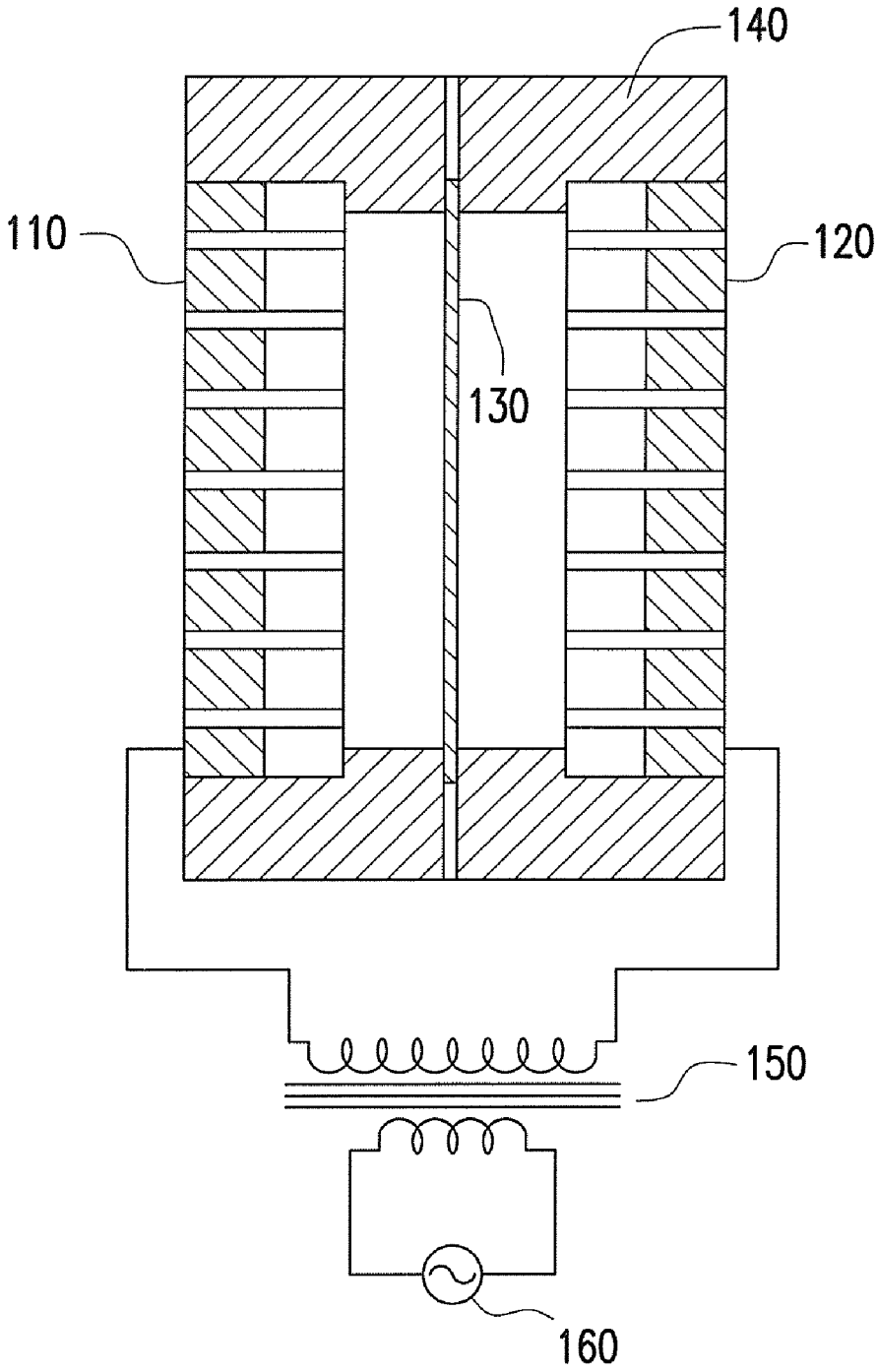
FIG. 1 (RELATED ART)
FIG. 1 is a schematic diagram illustrating a conventional speaker unit.

A flexible or a portable electronic device generally has features of softness, thinness and flexibility, and various applications thereof have a feature of low driving voltage. In one of embodiments, a sheet-based or a roll-based manufacturing process is used to manufacture a speaker, by which a flexible speaker can be manufactured. In some circumstances, processes such as stamping, die casting, and/or die bonding, etc. can be used to effectively control a cost of the manufacturing process.

According to one of embodiments, the method for manufacturing the speakers having large vibrating membrane areas, irregular shapes, or other customizable features may have a flexible design.

In one of embodiments, a speaker apparatus can include a base, a vibrating membrane located above the base, an electrode located above the vibrating membrane and a plurality of supporters. In some embodiments, the supporters may have different configuration patterns or heights, which can be varied according to different applications and specifications.

When the vibrating membrane is actuated by an external voltage, a flat electrostatic speaker functions when a surface of the vibrating membrane is deformed due to charge characteristics of the material of the vibrating membrane and the electrostatic force. Deformation of the vibrating membrane can drive the air around the vibrating membrane to generate sound. The force exerted on the vibrating membrane can be deduced or estimated according to an electrostatic formula and an energy law. For example, such force can be a capacitance of the whole speaker times an internal electric field and an input voltage. Generally, the greater the force exerted on the vibrating membrane is, the greater the output sound is.

The electrostatic speaker can be designed to be light, slim and flexible. The supporters can be disposed on the electrode or the vibrating membrane by using or without using an adhesive. A layout of the supporters can be varied according to one or a plurality of design considerations, for example, an electrostatic effect of the vibrating membrane, and a frequency response thereof, etc.

Design variations of the supporters at least include variation of a disposing manner of the supporters and height variations of the supporters. For example, the supporter can have a dot shape, a mesh shape, a cross shape, any other shapes, or combination of two or more shapes. Under different design considerations, a distance between any two of the supporters can be adjusted according to a frequency requirement of hearing, a frequency response, or other hearing or structural considerations.

The supporters can be fabricated on the porous electrode or the vibrating membrane through transfer printing, decaling, or direct printing such as inkjet printing, or screen printing. In another embodiment, the supporters can be fabricated by direct adhesion. For example, the supporters can be pre-fabricated, and then the pre-fabricated supporters are disposed between the porous electrode and the vibrating membrane. Then, by directly attachment or indirectly attachment the supporters to the lower porous electrode or the vibrating membrane, the supporters are disposed on the vibrating membrane or the porous electrode. For example, the supporters directly adhered or indirectly adhered to the lower porous electrode or the vibrating membrane. In the other embodiments, the supporters can be fabricated according to etching, photolithography and/or adhesive-dispensing techniques.

In one of embodiments, the speaker unit can include a single porous electrode and a single vibrating membrane having charges. The flexible vibrating membrane having an electret can be used to manufacture the speaker unit according to a sheet-based and a roll-based manufacturing processes. Conversely, a conventional manufacturing process probably requires a specific design and a specific manufacturing process, so that regarding a same design of the mass production, a specific and individual speaker design is generated. According to the manufacturing method of the mass production, generally, the vibrating membranes and the speakers are respectively manufactured according to the same design, which is hard to be modified during the manufacturing process. For example, the stamping, the die casting and the adhesion processes can be performed in the roll-based manufacturing process conformed to the disclosure of the present embodiment to fabricate primary products (i.e. the vibrating membranes) of the speaker. The vibrating membranes can be fabricated in a large area, for example, a roll vibrating membrane is fabricated, and then a cutting process is performed to the roll vibrating membrane. The aforementioned manufacturing process can effectively reduce a manufacturing cost of the speaker. Especially, the roll primary product may have a characteristic of flexibility for various designs, especially for designs of large area, irregular shape or other customisable shapes, or designs requiring a plurality of variations.

Figure 2:
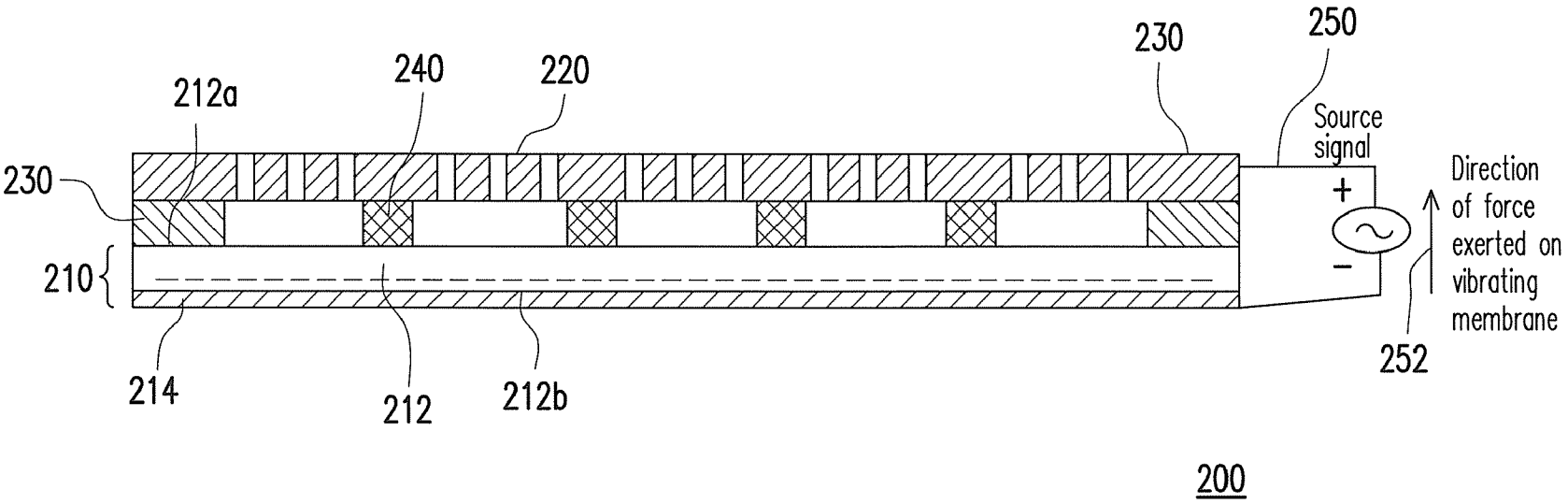
FIG. 2 is a schematic diagram illustrating a speaker structure fabricated based on a speaker manufacturing method according to one of embodiments.

Referring to FIG. 2, FIG. 2 is a schematic diagram illustrating a speaker structure fabricated based on a speaker manufacturing method according to one of embodiments. The speaker unit structure 200 includes a vibrating membrane 210, a porous electrode 220, a frame supporter 230 and a plurality of supporters 240 between the porous electrode 220 and the vibrating membrane 210. The vibrating membrane 210 includes an electret vibrating membrane layer 212 and a metal thin-film electrode 214. One side 212*a* of the electret vibrating membrane layer 212 is connected to the frame supporter 230 and the supporters 240, and another side 212*b* is electrically connected to the metal thin-film electrode 214.

The porous electrode 220 can be made of a metal material, and in an embodiment, the porous electrode 220 can also be made by plating a layer of metal thin-film on an elastic material, for example, paper or a very thin non-conductive material.

A material of the electret vibrating membrane layer 212 can be a dielectric material. The dielectric material can retain static charges for a long time after being electrized, and after a charging process, a charge-maintaining effect is generated in internal of the material, so that it is referred to as the electret vibrating membrane layer. The electret vibrating membrane layer 212 can be made of a single layer or multi layers of dielectric material, and the dielectric material can be, for example, fluorinated ethylenepropylene (FEP), polytetrafluoethylene (PTFE), polyvinylidene fluride (PVDF), fluorine polymer, and other suitable materials, etc. Such dielectric material includes holes of micrometer size or nano-micro meter size in internal thereof. Since the electret vibrating membrane layer 212 is made of the electrized dielectric material, it can long time retain static charges and piezoelectricity, and internal of the electret vibrating membrane layer 212 has the nano-micro meter size holes, so that a transmittance and a piezoelectric property thereof are improved. Dipolar charges are generated in the internal of the material after a corona charging process, so as to achieve the charge-maintaining effect.

The metal thin-film electrode 214 can be a very thin metal thin-film electrode to avoid influencing a tension and vibration effect of the vibrating membrane 210. The so-called "very thin" refers to a thickness about 0.2 μm to 0.80 μm. In an embodiment, the thickness is about 0.2 μm to 0.4 μm, which can be 0.3 μm.

The electret vibrating membrane layer 212 filled with negative charges is taken as an example. A source signal 250 is a sinusoid (i.e. the source signal 250 has a positive voltage at one moment, and has a negative voltage at another moment), and the source signal 250 is respectively input to the porous electrode 220 and the metal thin-film electrode 214. When the source signal 250 connected to the porous electrode 220 has the positive voltage, the porous electrode 220 attracts the negative charges on the electret vibrating membrane layer 212 of the speaker unit structure 200, and when the source signal 250 has the negative voltage, the porous electrode 220 repulses the negative charges on the electret vibrating membrane layer 212, so that vibration of the vibrating membrane 210 is generated, for example, a direction 252 of force exerted on the vibrating membrane 210 as that shown in FIG. 2. When the vibrating membrane 210 is vibrated in different directions, alternatively caused by the repulsive force or the attractive force, sounds are generated and output due to compression of the peripheral air.

Materials of the vibrating membrane 210, the porous electrode 220 and the frame supporter 230 of the speaker unit structure 200 can be flexible materials, which can be transparent materials, so as to increase a design diversity to form a soft flexible speaker.

Figure 3A:
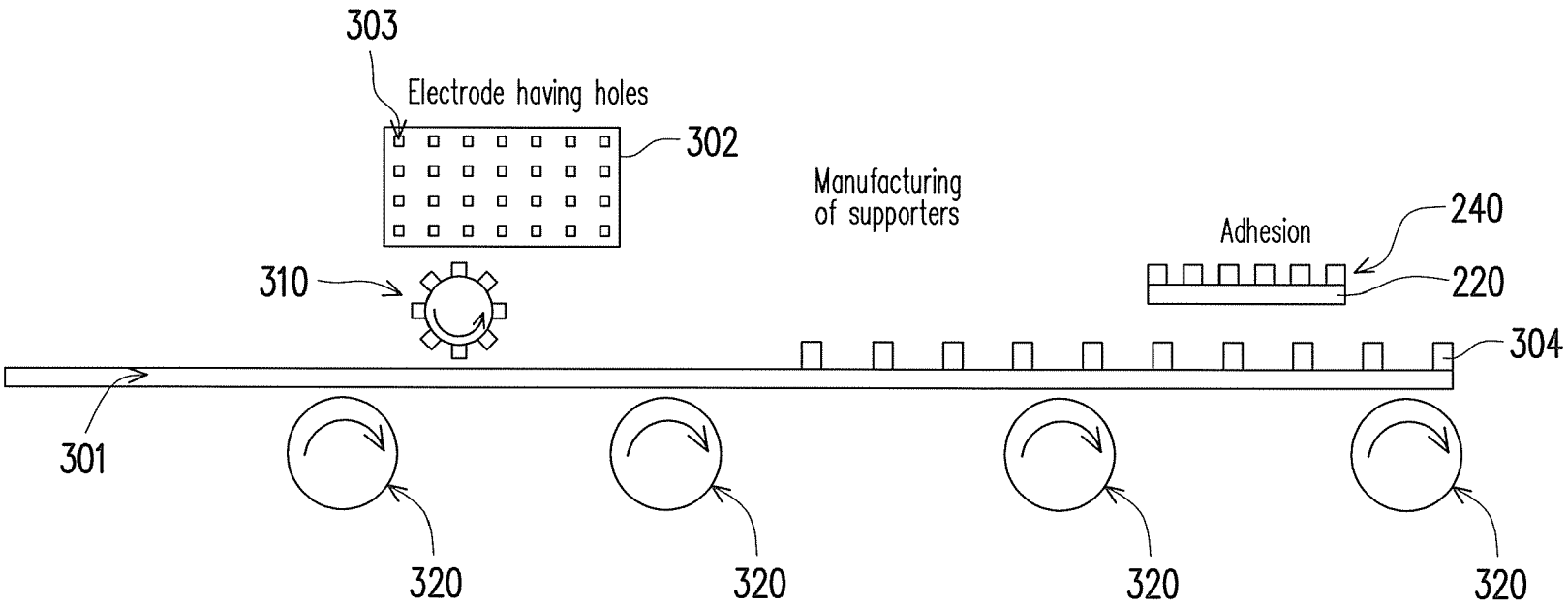
FIG. 3A is a schematic diagram illustrating a process of fabricating a porous electrode having supporters during a roll-based manufacturing process of a flexible speaker according to one of embodiments.

During a manufacturing process of the speaker unit structure 200, the porous electrode 220 and the supporters 240 can be fabricated in a same process, and the vibrating membrane 210 and the frame supporter 230 can be fabricated in another process, which are described with reference of FIG. 3 and FIG. 4. Referring to FIG. 3A, FIG. 3A is a schematic diagram illustrating a process of fabricating a porous electrode having supporters in a flexible speaker according to one of embodiments. In the manufacturing process of FIG. 3A, the supporters 240 are formed on top of the porous electrode 220. The porous electrode 220 can be made of flexible materials such as metal materials or metal-plated thin-films. The flexible material can be papers or super thin non-conductive materials. The porous electrode 220 having the supporters 240 can be manufactured according to three manufacturing processes including forming the porous electrode having a plurality of holes, forming the supporters and combining the supporters with the porous electrode.

As described above, the supporters 240 are located between the vibrating membrane 210 and the porous electrode 220. In an embodiment, an adhesive or other adhering methods can be used to adhere the supporters 240 onto a surface of the porous electrode 220, or an adhesive or other adhering methods can be used to adhere the supporters 240 onto a surface of the vibrating membrane 210, or the supporters are disposed between the porous electrode 220 and the vibrating membrane 210. For example, the supporters 240 can be adhered onto the surface of the porous electrode 220. The supporters 240 may have various shapes, for example, triangular prisms, cylinders, hexagons or rectangles. As described above, deployment, layout, height, shape and other features of the supporters can be changed according to one or a plurality of design considerations.

Referring to FIG. 3A, a plurality of rollers 320 or other mechanical material feeders can be driven forwards to feed a substrate 301 of a porous electrode 302. A device 310 capable of performing stamping, cutting (cutter or laser cutter) or etching, etc. can be used to form holes 303 on the substrate 301 of the porous electrode 302, so as to form the porous electrode 302. In a next step, a plurality of supporters (shown as supporters 304 of FIG. 3A) with various shapes is formed, for example, granular, square or hexagonal supporter structures can all be applied to such design. For example, the same system or another mechanical device can be used to form the supporters 304. Then, the supporters 304 are bonded or adhered to the porous electrode 302 having the holes 303, wherein an adhesive used for bonding or adhering can be cured by ultraviolet light, heat or pressure, etc. according to a material characteristic of the adhesive. In another embodiment, if the supporters 304 are not required to be adhered to the porous electrode 302, such step of adhesion can be omitted. Therefore, a large amount of the porous electrodes 302 having the supporters 304 can be manufactured. Taking the illustrated embodiment as an example, the manufactured porous electrode 302 may have the supporters 240 formed on or adhered to the porous electrode 302.

Figure 3B:
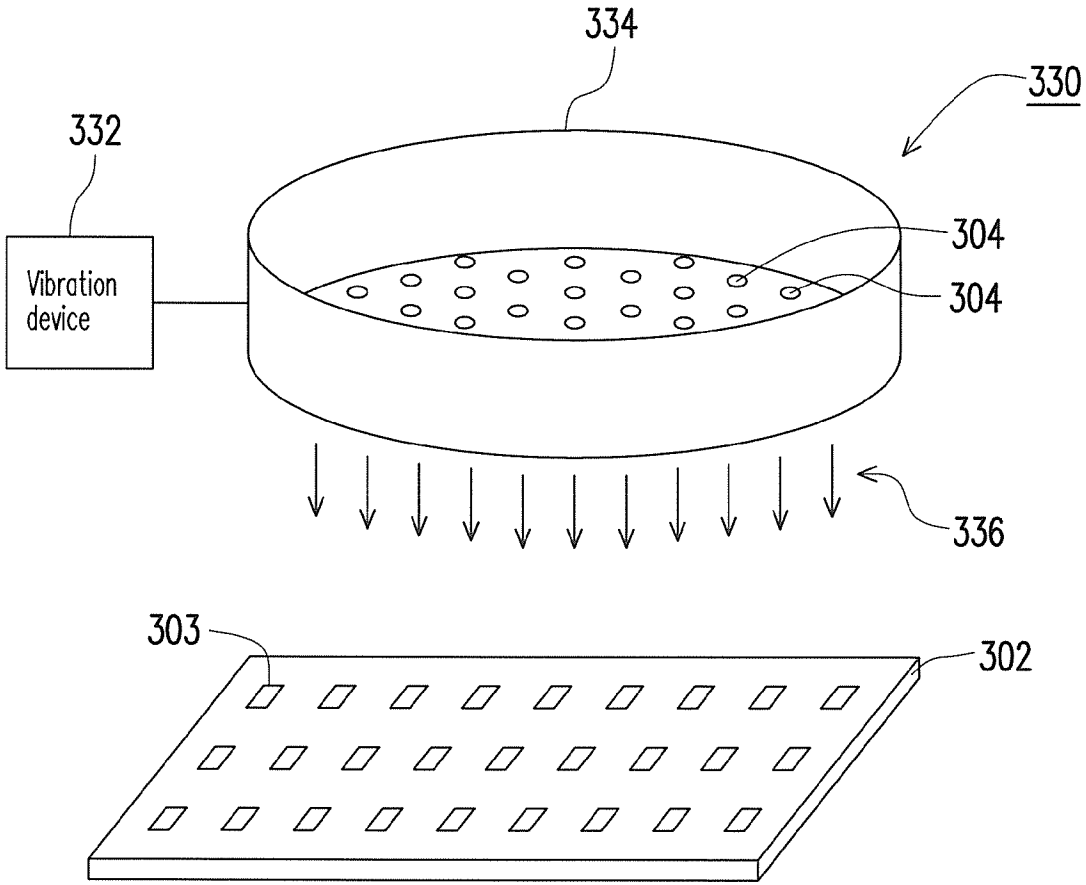
FIGS. 3B and 3C are respectively schematic diagrams illustrating devices for positioning and configuring supporters on a porous electrode according to one of embodiments.
Figure 3C:
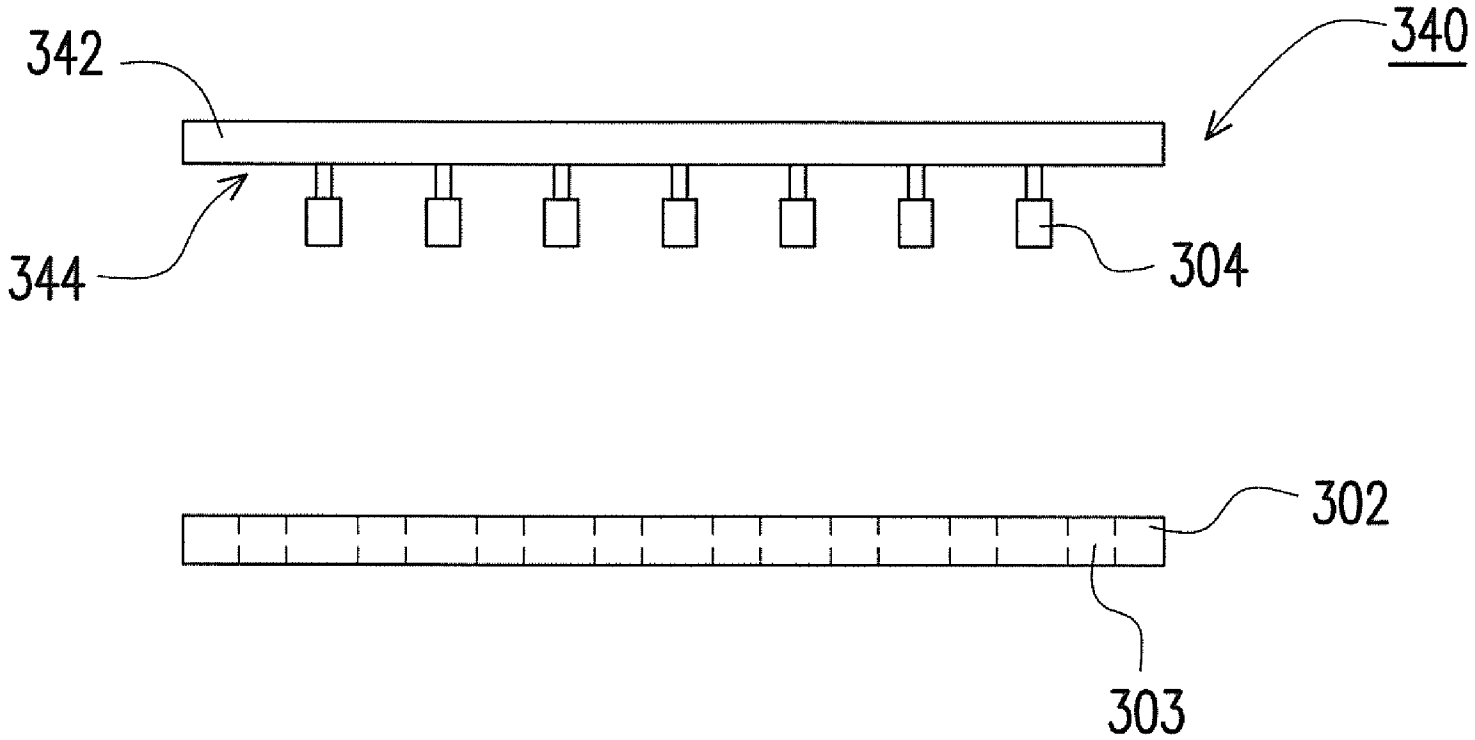

The method of configuring the supporters 304 on the porous electrode 302 is to use a vibration mechanism or an alignment mechanism, etc. to position the supporters 304 at predetermined positions on the porous electrode 302. Referring to FIG. 3B, in an embodiment, a vibration mechanism 330 including a vibration device 332 and a carrier plate 334 having holes is used, wherein positions of the holes correspond to the predetermined positions on the porous electrode 302 where the supporters 304 are about to be configured. After the supporters 304 are loaded into the carrier plate 334, the supporters 304 penetrate through the holes and are aligned to the porous electrode 302. In another embodiment, referring to FIG. 3C, an alignment mechanism 340 including a positioning carrier 342 and a clamping unit 344 is used, wherein the clamping unit 344 clamps the supporters 344 to align the supporters 304 on the porous electrode 302. The aforementioned embodiments and components or combinations equivalent to the embodiments are all within the scope of the invention.

Figure 4A:
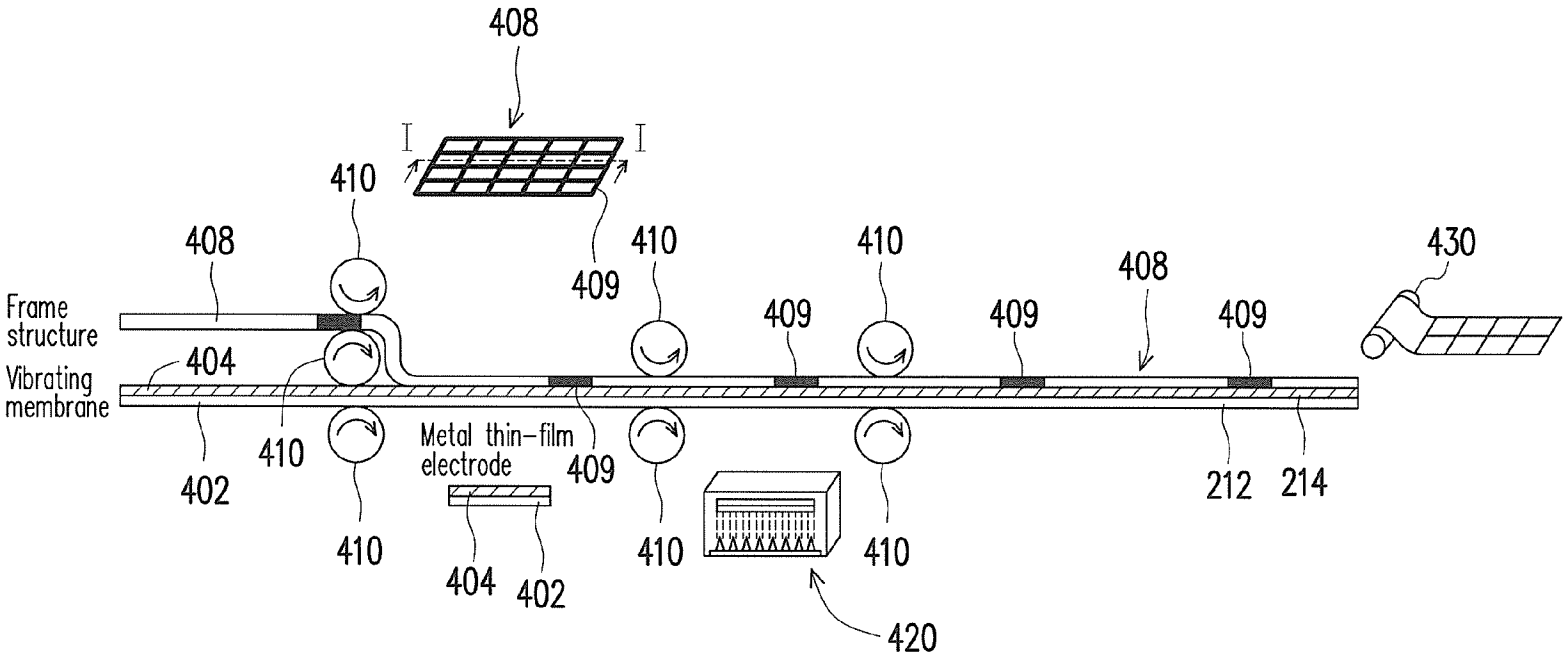
FIG. 4A is a schematic diagram illustrating a process of fabricating a vibrating membrane having a fixed frame based on a roll-based manufacturing process according to one of embodiments.

FIG. 4A is a schematic diagram illustrating a process of fabricating a vibrating membrane having a fixed frame based on a roll-based manufacturing process according to one of embodiments, which illustrates an embodiment of fabricating the vibrating membrane having the fixed frame. Rollers 410 or a mechanical material feeder can be driven forwards to feed a roll material. The manufacturing process includes forming a vibrating membrane layer having a super thin conductive metal layer, combining a frame structure with the vibrating membrane layer, and performing a charge-maintaining process (for example, a corona discharging process, etc.) to the vibrating membrane layer to form an electret vibrating membrane layer, and cutting the electret vibrating membrane layer to form individual vibrating membranes of the speaker. Wherein, the frame structure can provide a suitable tension to the vibrating membrane. Then, a roll vibrating membrane is formed, i.e. the vibrating membranes are rolled to form a roll element 430.

In an embodiment, a super thin metal layer 404 can be formed on the vibrating membrane or a vibrating membrane material substrate 402 by sputtering, plating or coating an electrode layer, or the electrode layer can be formed by attaching a metal thin-film on the vibrating membrane. In an embodiment, a roll material of the vibrating membrane can be selected, designed or extended to obtain a suitable tension to suitably combine the frame structure with the vibrating membrane. A frame substrate having suitable tension can be formed on the vibrating membrane layer, so as to provide the frame structure 408 of FIG. 4B. In an embodiment, the frame structure 408 has a plurality of rectangular grids formed by frame elements 409. In these layers, the speaker unit in the frame structure 408 may have a suitable tension level or surface tension, so as to avoid a curling problem that probably causes shedding of a certain layer. The frame elements 409 are not limited to have shapes of rectangles, which may have various shapes or arrangements.

Moreover, the vibrating membrane 402 can be processed to provide charges. For example, a point discharge device 420 can be used to perform the charge-maintaining process (for example, a ferroelectric process or a corona discharging process). In an embodiment, the point discharge device 420 can use probes arranged in an array for discharging. In an embodiment, processing conditions such as temperature, humidity and a discharge level can be controlled to adjust or ameliorate the charging effect. Although the above processing is immediately executed after the frame structure 408 and the vibrating membrane 402 are combined, it can also be executed earlier or later during the manufacturing process.

Figure 4B:
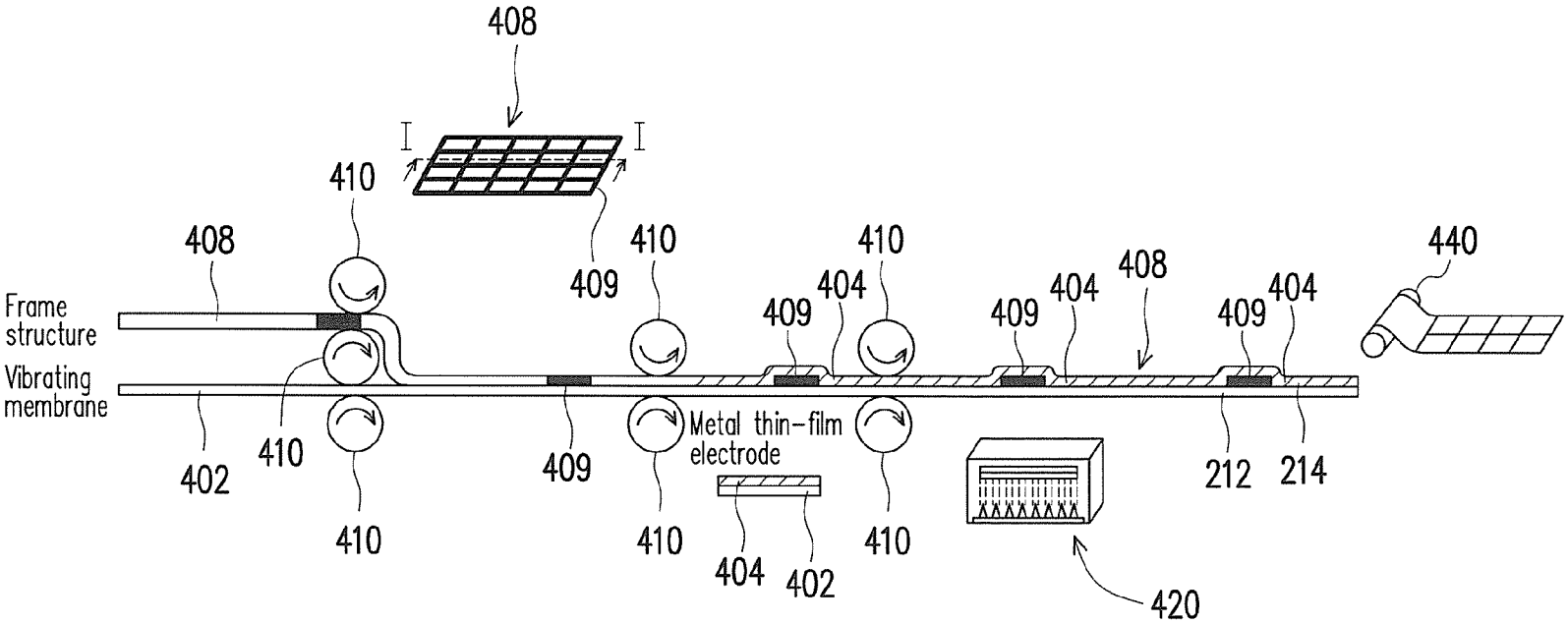
FIG. 4B is a schematic diagram illustrating a process of fabricating a vibrating membrane having a fixed frame based on a roll-based manufacturing process according to another one of embodiments.

FIG. 4B is a schematic diagram illustrating a process of fabricating a vibrating membrane having a fixed frame based on a roll-based manufacturing process according to another one of embodiments, which illustrates another embodiment of fabricating the vibrating membrane having the frame structure. A difference between the embodiment of FIG. 4B and that of FIG. 4A is that in FIG. 4B, the vibrating membrane (electret) is first adhered to the frame structure 408 under a certain tension, and the metal electrode is fabricated on the vibrating membrane through a sputtering process, and then the charge-maintaining process is performed. As shown in FIG. 4B, the frame elements 409 are covered by the metal electrode layer 404, which is different to that of FIG. 4A, and a method of covering the metal electrode layer 404 is the same as that described in the embodiment of FIG. 4A. Referring to FIG. 4B, the rollers 410 or the other mechanical material feeders can be driven forwards to feed a roll material. The manufacturing process includes forming the frame elements 409 of the frame structure 408 and the vibrating membrane 402, forming the metal electrode layer 404 on the vibrating membrane 402, performing the charge-maintaining process to the vibration film 402 to form the electret vibrating membrane layer, and cutting the electret vibrating membrane layer to form individual vibrating membranes of the speaker. The frame structure can provide a suitable tension to the vibrating membrane. Then, a roll vibrating membrane is formed, i.e. the vibrating membranes are rolled to form a roll element 440.

Similar to the manufacturing process of FIG. 4A, tensions or tensile strengths of the materials of different layers can be considered or adjusted to avoid the curling problem that probably causes peeling or shedding of one or multiple layers. The frame elements 409 are not limited to have shapes of rectangles, which may have various shapes or arrangements.

The super thin metal electrode layer 404 can be formed on the vibrating membrane 402 by sputtering, plating or coating an electrode layer, or the electrode layer can be formed by attaching a metal thin-film on the vibrating membrane.

Moreover, the vibrating membrane 402 can be processed to provide charges. For example, the point discharge device 420 can be used to perform the charge-maintaining process (for example, a ferroelectric process or a corona discharging process). In an embodiment, the point discharge device 420 can use probes arranged in an array for discharging. In an embodiment, the processing conditions such temperature, humidity and a discharge level can be controlled to adjust or ameliorate the charging effect. Although the above processing is executed after the frame structure 408 and the vibrating membrane 402 are combined, it can also be executed earlier or later during the manufacturing process.

Figure 5:
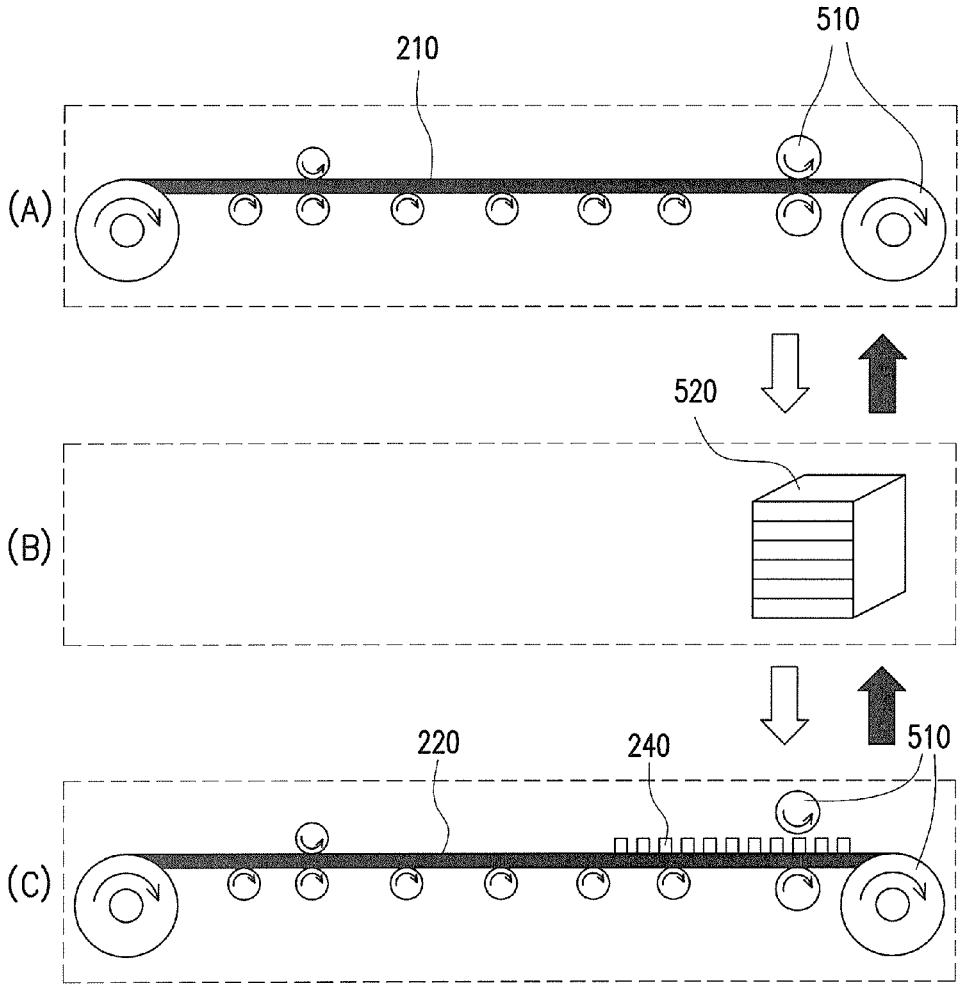
FIG. 5 is a schematic diagram illustrating a method for manufacturing a speaker according to one of embodiments.

Then, referring to FIG. 5, FIG. 5 is a schematic diagram illustrating a method for manufacturing a speaker according to one of embodiments. In FIG. 5, part (A) is a simplified schematic diagram illustrating a process of fabricating the vibrating membrane having the fixed frame of FIG. 4A or FIG. 4B, and part (C) is a simplified schematic diagram illustrating a process of fabricating the porous electrode having the supporters of FIG. 3. Wherein, the vibrating membrane 210 and the porous electrode 220 are all manufactured through rollers 510 according to the roll-based manufacturing process.

In the embodiment, the vibrating membrane 210 fabricated in the part (A) is cut into a plurality of sheet vibrating membranes, and the cut sheet vibrating membranes are inserted into a temporary storage device 520 through an inserting device. Then, an extracting device is used to extract the sheet vibrating membranes from the temporary storage device 520 and place the sheet vibrating membranes on the porous electrode 220 and the supporters 240 fabricated in the part (C), and then the sheet vibrating membranes are combined with the porous electrode having the supporters. The above steps are sequentially carried out according to a direction shown by hollow arrows in FIG. 5.

Conversely, the above steps can also be sequentially carried out according to a direction shown by solid arrows in FIG. 5. In the part (C), the porous electrode 220 having the supporters 240 is first cut into a plurality of sheet porous electrodes, and the cut sheet porous electrodes are inserted into the temporary storage device 520 through the inserting device. Then, the extracting device is used to extract the sheet porous electrodes from the temporary storage device 520 and place the sheet porous electrodes on the vibrating membrane 210 fabricated in the part (A), and then the sheet porous electrodes are combined with the vibrating membrane 210.

Wherein, the temporary storage device 520 can be used together with the roll-based manufacturing process or can be independently used.

Figure 6:
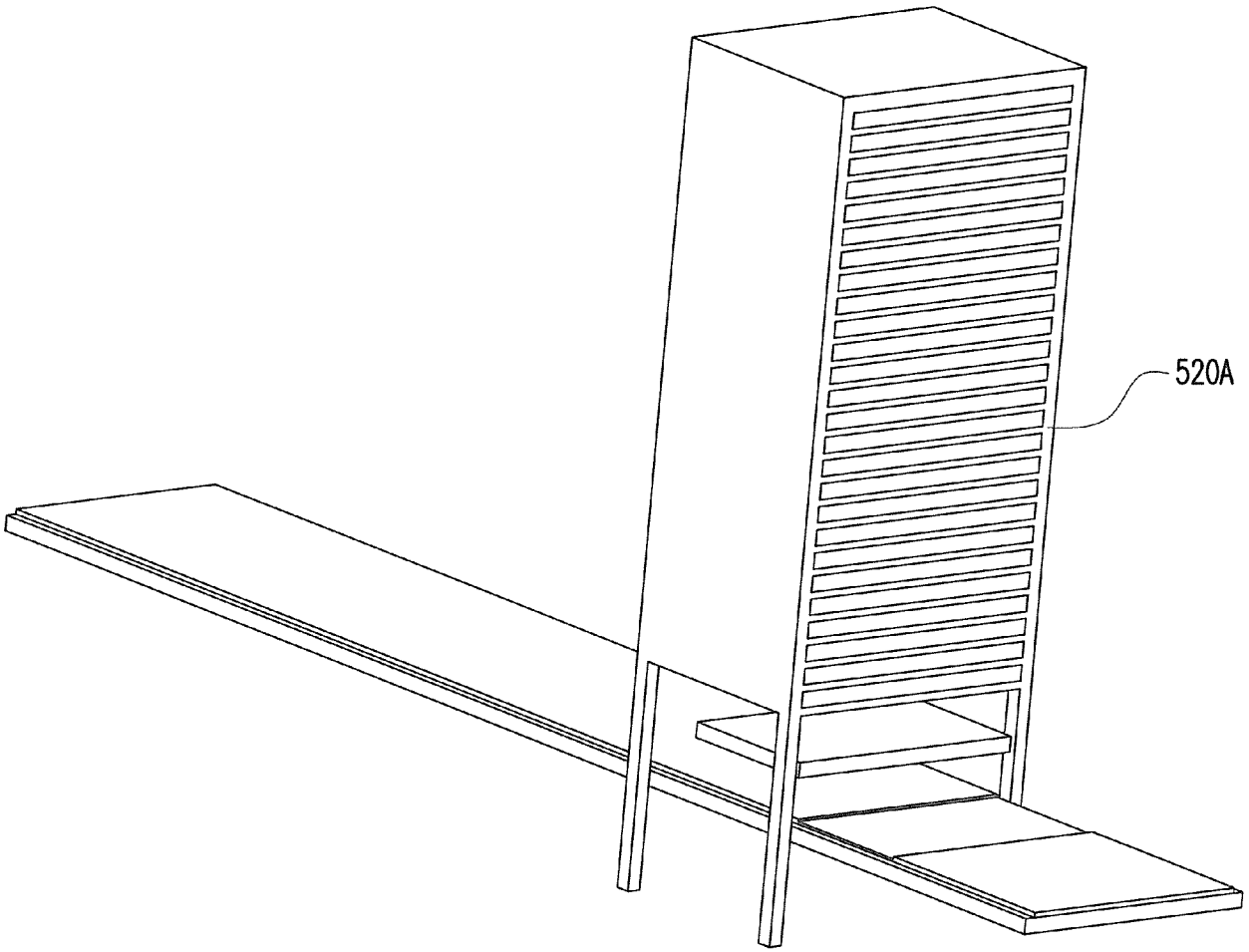
FIG. 6 is a schematic diagram illustrating a method for manufacturing a speaker according to one of embodiments.

Then, referring to FIG. 6, FIG. 6 is a schematic diagram illustrating a method for manufacturing the speaker according to one of embodiments. In FIG. 6, the temporary storage device is a chamber 520A, and the chamber 520A carries the sheet vibrating membranes or the sheet porous electrodes in a vertical stacking mode. In the embodiment, the inserting device (not shown) inserts the sheet vibrating membranes or the sheet porous electrodes into the chamber 520A according to any specific order. Then, the extracting device (not shown) places the sheet vibrating membranes or the sheet porous electrodes carried by the chamber 520A on the lower roll porous electrode or the roll vibrating membrane. The extracting device extracts the sheet vibrating membranes or the sheet porous electrodes according to any specific order, and the inserting device or the extracting device can be a mechanical arm, a clamping mechanism, a guide mechanism or an adsorption mechanism, etc.

Figure 7:
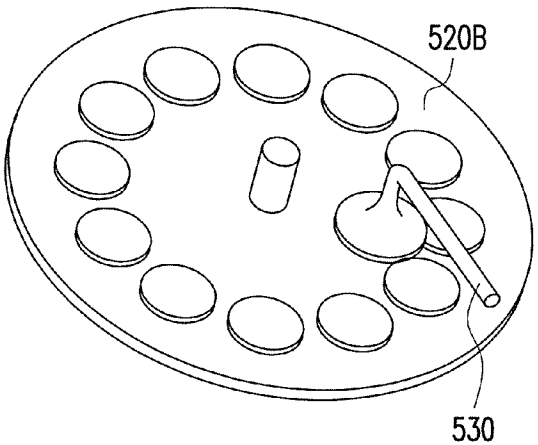
FIG. 7 is a schematic diagram illustrating a method for manufacturing a speaker according to one of embodiments.
Figure 7:
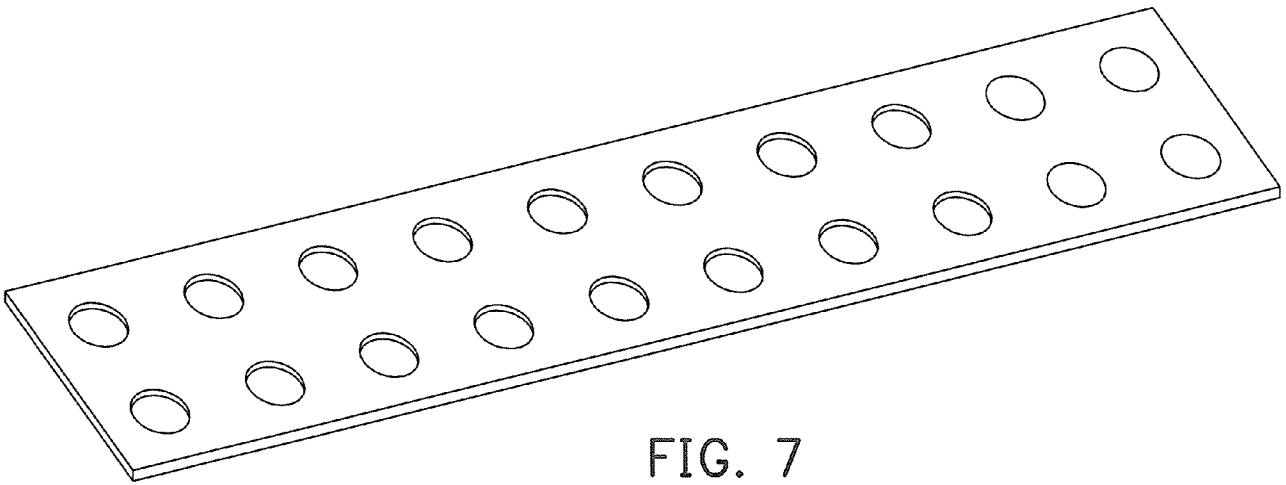

Referring to FIG. 7, FIG. 7 is a schematic diagram illustrating a method for manufacturing the speaker according to one of embodiments. In FIG. 7, the temporary storage device is a horizontal carrier 520B having compartments, and the horizontal carrier 520B having compartments carries the sheet vibrating membranes or the sheet porous electrodes in a horizontal layout mode. In the embodiment, an inserting device 530 inserts the sheet vibrating membranes or the sheet porous electrodes into the horizontal carrier 520B according to any specific order. Then, the extracting device (not shown) places the sheet vibrating membranes or the sheet porous electrodes carried by the horizontal carrier 520B having compartments on the lower roll porous electrode or the roll vibrating membrane. The extracting device extracts the sheet vibrating membranes or the sheet porous electrodes according to any specific order, wherein the extracting device can also be an adsorption device as that of the inserting device 530.

Figure 8:
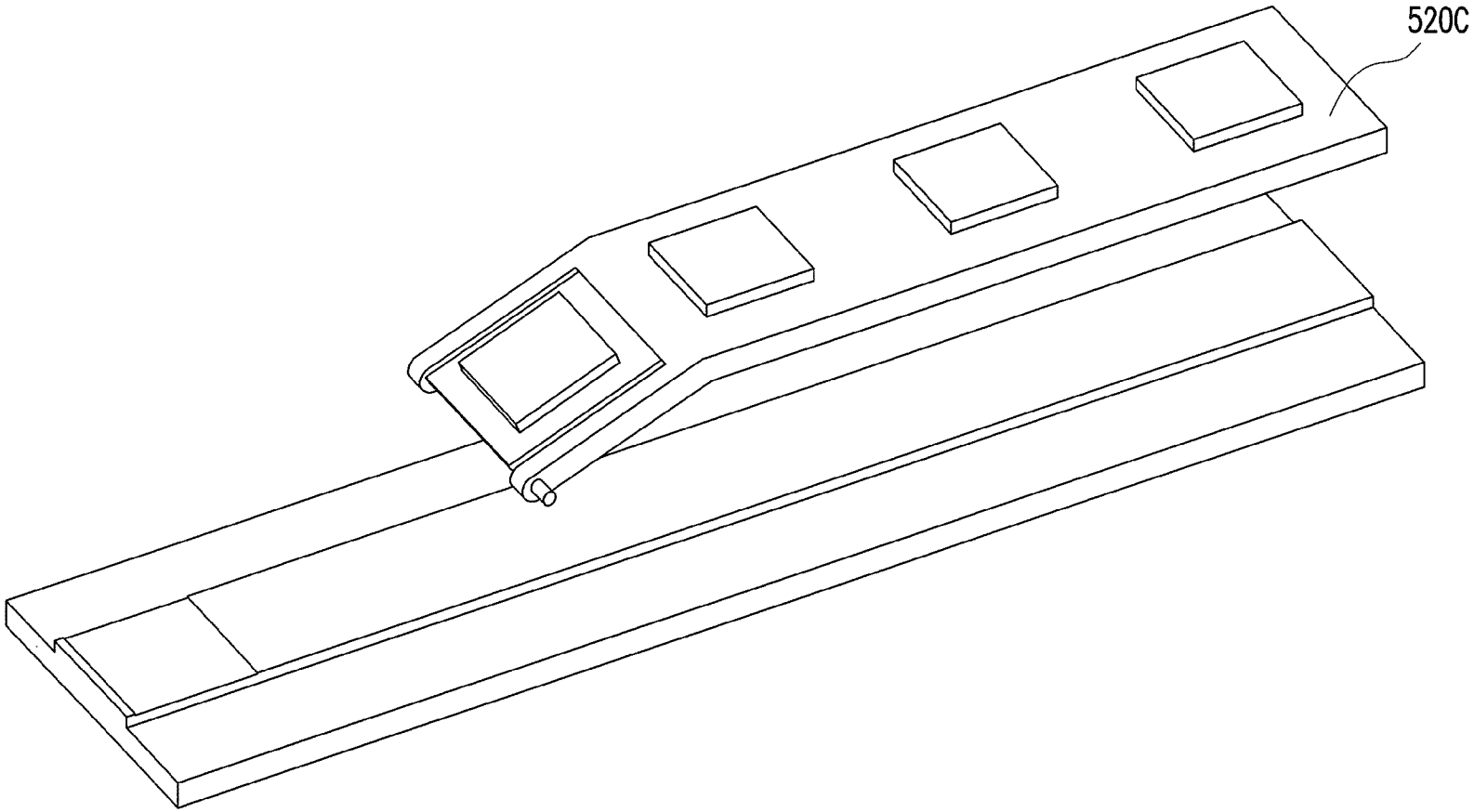
FIG. 8 is a schematic diagram illustrating a method for manufacturing a speaker according to one of embodiments.

Moreover, referring to FIG. 8, FIG. 8 is a schematic diagram illustrating a method for manufacturing the speaker according to one of embodiments. In FIG. 8, the temporary storage device is a horizontal transmission belt 520C, and the horizontal transmission belt 520C carries the sheet vibrating membranes or the sheet porous electrodes in a linear arrangement mode. In the embodiment, the inserting device (not shown) inserts the sheet vibrating membranes or the sheet porous electrodes onto the horizontal transmission belt 520C according to any specific order. Then, the extracting device (not shown) places the sheet vibrating membranes or the sheet porous electrodes carried by the horizontal transmission belt 520C on the lower roll porous electrode or the roll vibrating membrane. The extracting device extracts the sheet vibrating membranes or the sheet porous electrodes according to any specific order, wherein the inserting device or the extracting device can be an adsorption device, etc.

Moreover, in one of embodiments, the temporary storage device can also be a slide rail device.

In the aforementioned one of embodiments, the inserting device can hold the sheet vibrating membranes or the sheet porous electrodes through mechanical clamping, vacuum adsorption, or static adsorption, etc. Moreover, the extracting device can hold the sheet vibrating membranes or the sheet porous electrodes through the mechanical clamping, the vacuum adsorption, or the static adsorption, etc. The sheet vibrating membranes or the sheet porous electrodes can be combined with the roll porous electrode or the roll vibrating membrane through laminating or attaching.

Figure 9A:
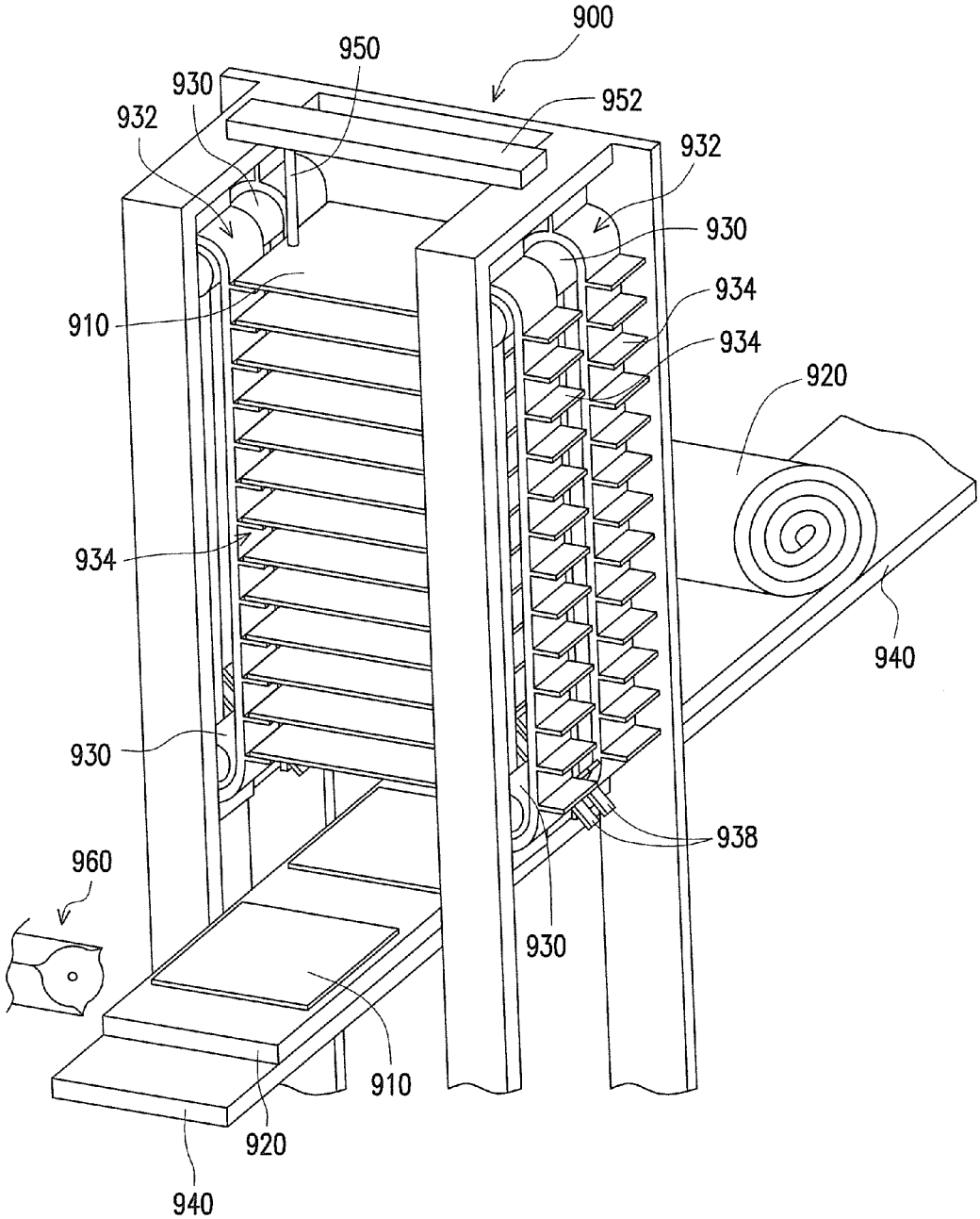
FIG. 9A is a schematic diagram illustrating a chamber structure according to one of embodiments.
Figure 9B:
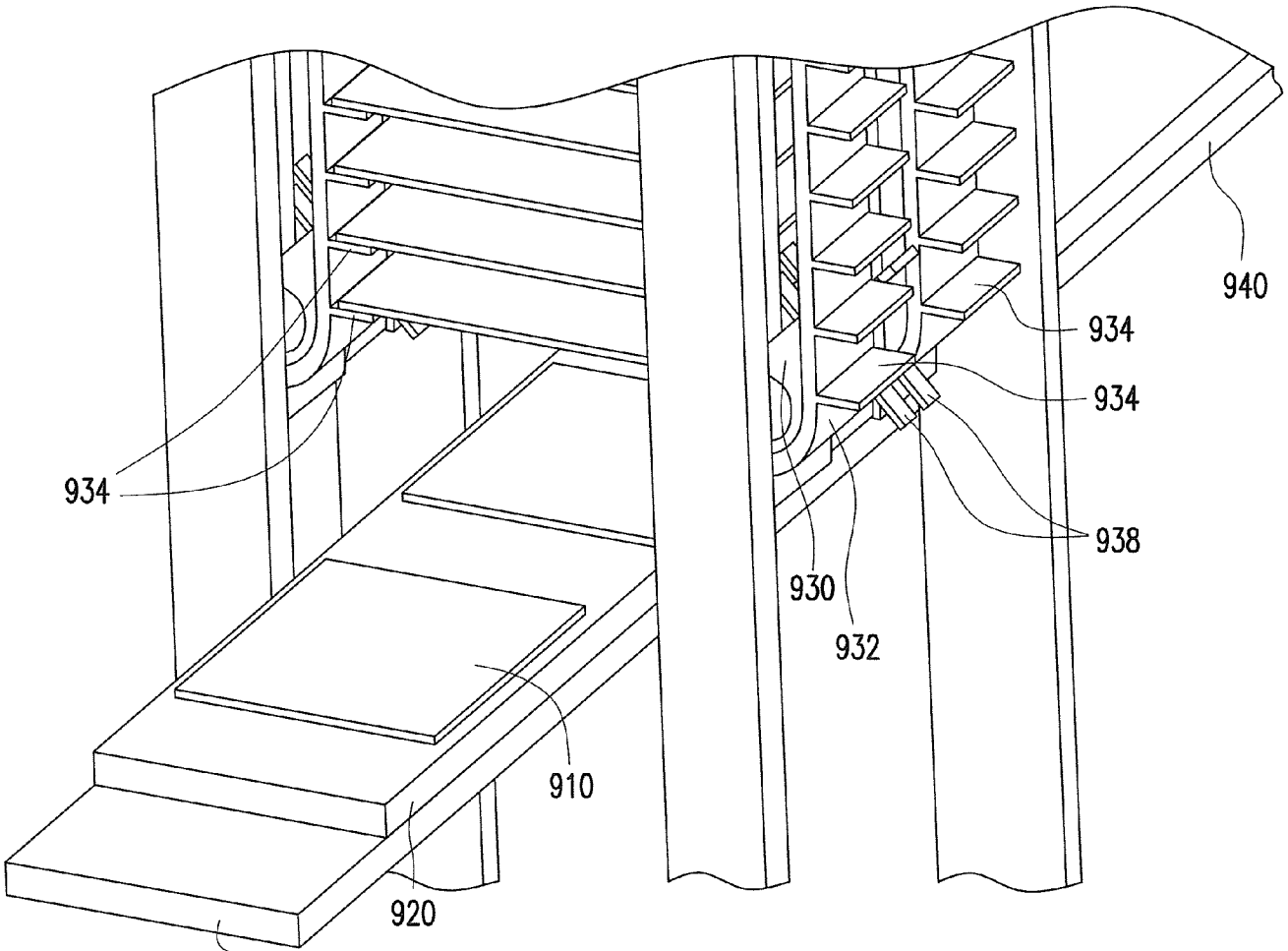
FIG. 9B is a partial enlarged diagram of a chamber structure according to one of embodiments.
Figure 9C:
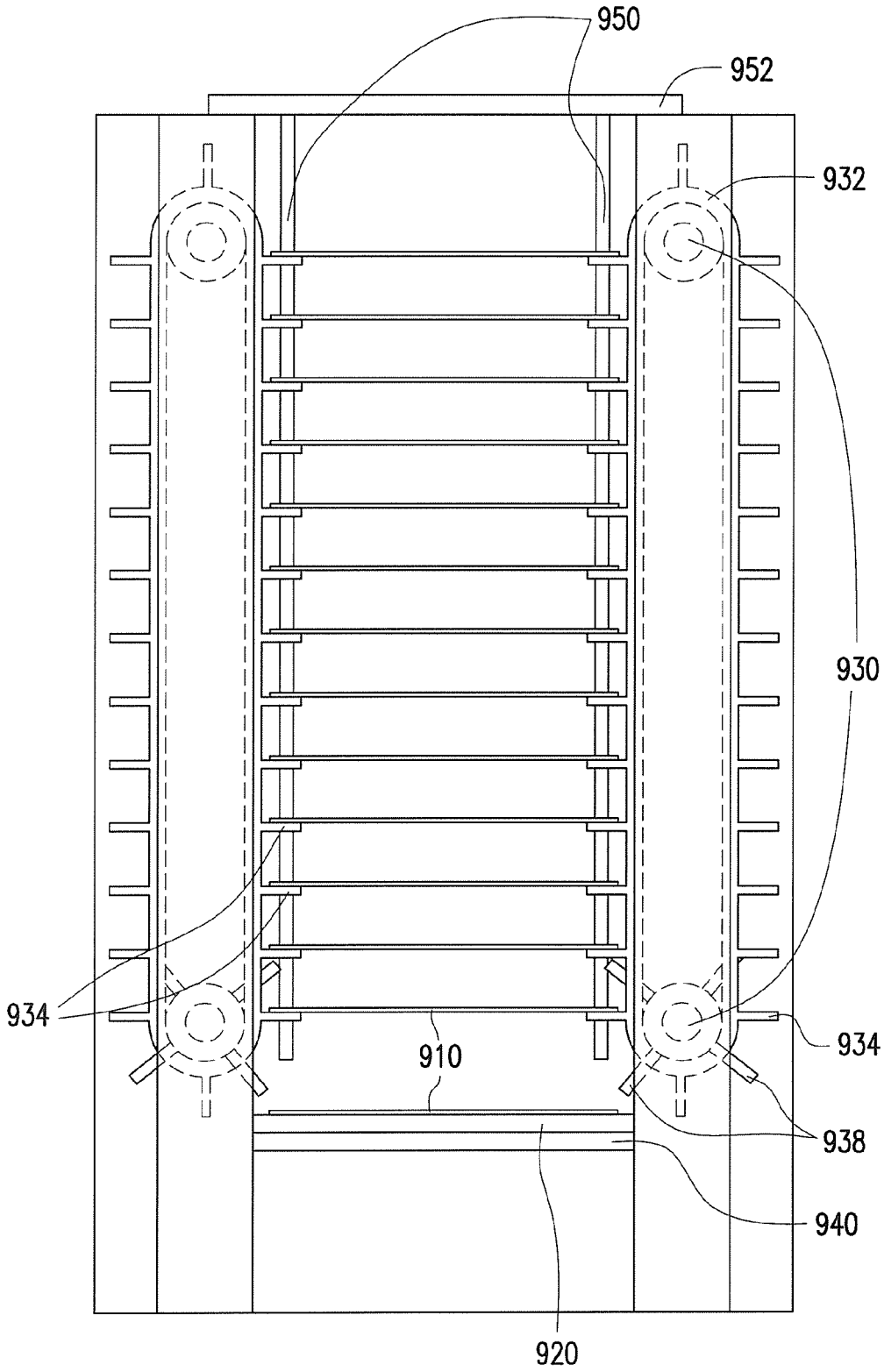
FIG. 9C is a front view of a chamber structure of FIG. 9A.
Figure 9D:
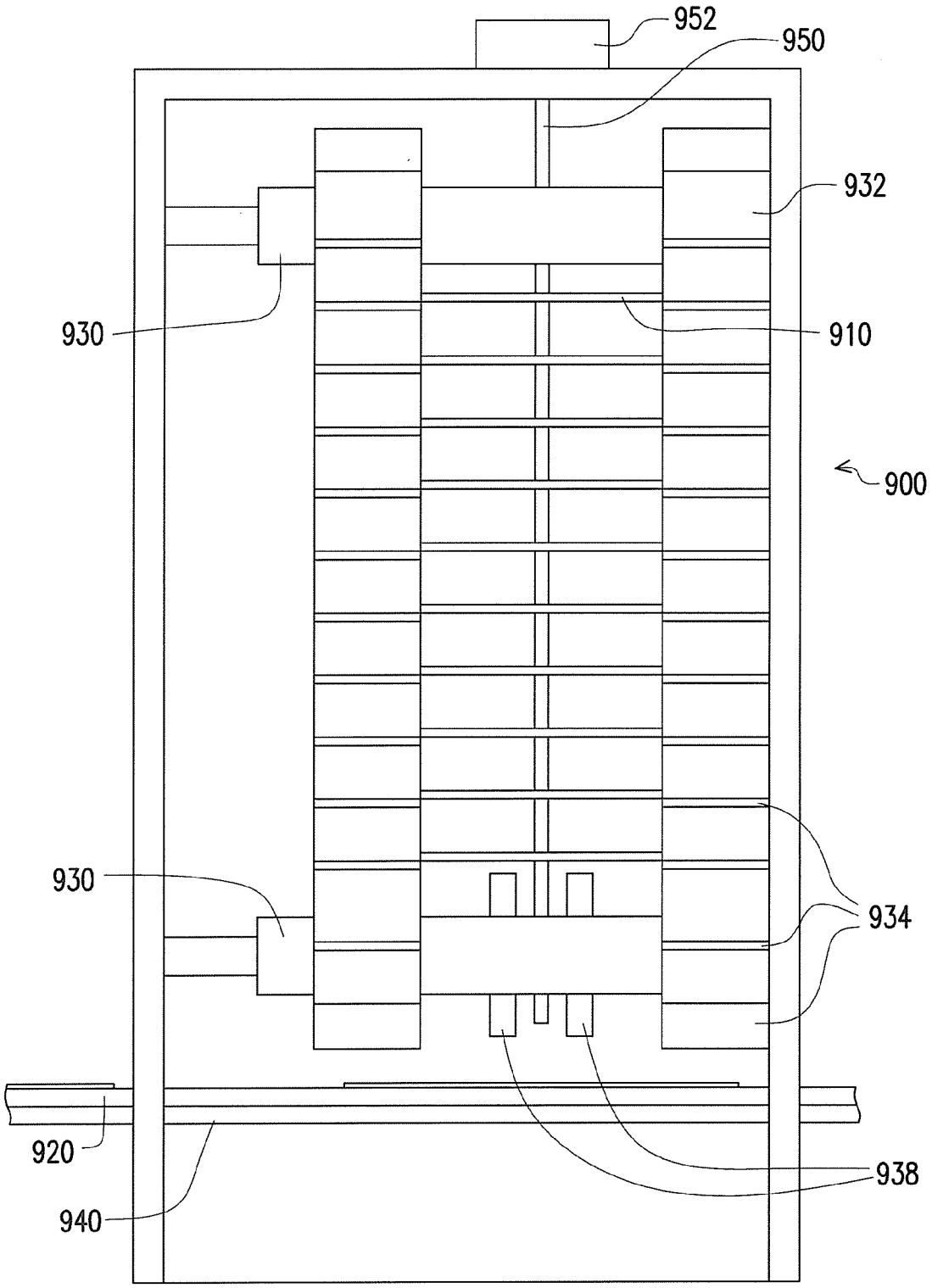
FIG. 9D is a side view of a chamber structure of FIG. 9A.

Referring to FIG. 9A and FIG. 9B, FIG. 9A and FIG. 9B are respectively a schematic diagram and a partial enlarged diagram of a chamber structure 900 according to one of embodiments. FIG. 9C and FIG. 9D are respectively a front view and a side view of the chamber structure 900 of FIG. 9A.

As shown in FIG. 9A, a transmission belt 932 is driven by a plurality of transmission devices 930 to place sheet elements 910 (for example, the sheet vibrating membranes or the sheet porous electrodes) on a lower roll element 920 (for example, the roll porous electrode or the roll vibrating membrane), wherein the roll element 920 has been spread to form a flat strip-like element. A plurality of support protrusion units 934 are configured on the transmission belt 932 for supporting the sheet elements 910. A handle 938 is configured on the transmission devices 930 for pulling the sheet elements 910, so that the sheet elements 910 can be smoothly separated from the support protrusion units 934.

The roll element 920 is transmitted by a transmission belt 940. The chamber structure 900 further includes a plurality of tension rod 950 for separating the sheet elements 910 form a support board 952 when the sheet elements 910 are loaded. The sheet elements 910 are downloaded to the transmission system one by one from the top of the tension rod 950. After the sheet elements 910 are loaded, a top end of the tension rod 950 can be fixed to the upper support board 952, and then fixed to the whole transmission system. By penetrating the tension rod 950 through the sheet elements 910, extra tension is provided, so that the sheet elements 910 can be more precisely combined with the roll element 920 without occurrence of distortion and deformation. When the roll element 920 enters a lower part of the chamber structure 900, and after it is combined to the sheet elements 910, a cutting tool 960 is used to cut the roll element 920 to form the speaker units.

Figure 10A:
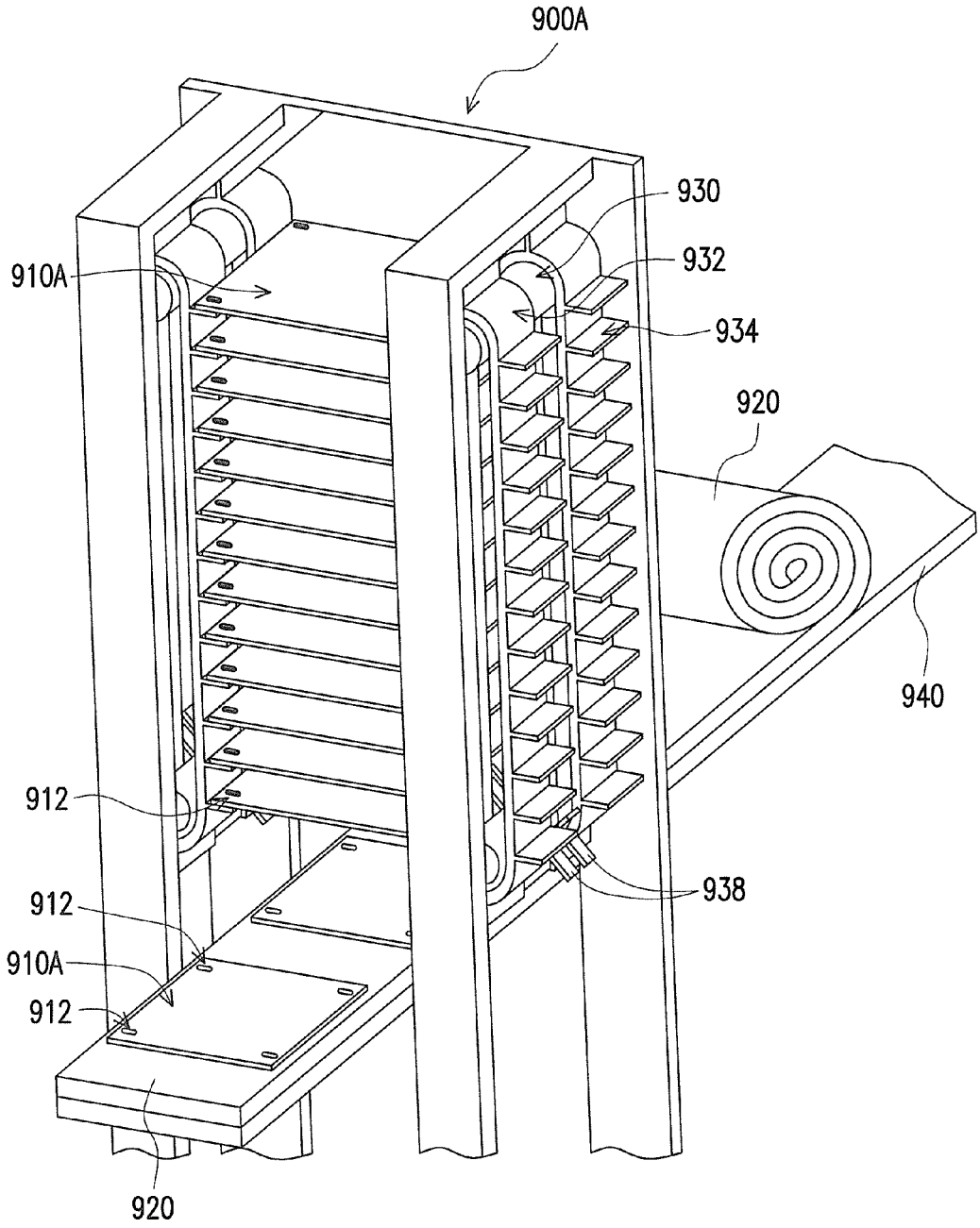
FIG. 10A is a schematic diagram illustrating a chamber structure according to one of embodiments.
Figure 10B:
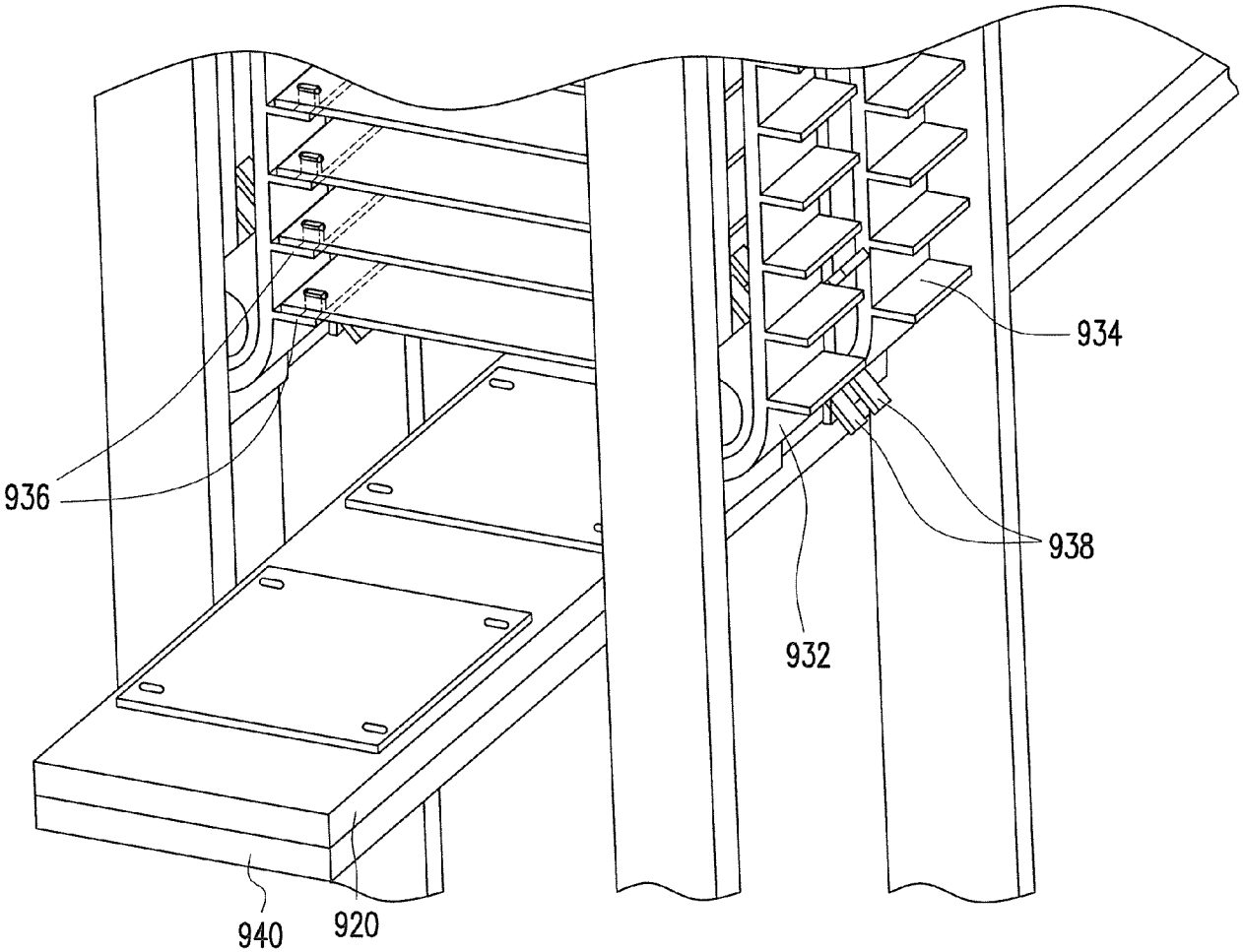
FIG. 10B is a partial enlarged diagram of a chamber structure according to one of embodiments.
Figure 10C:
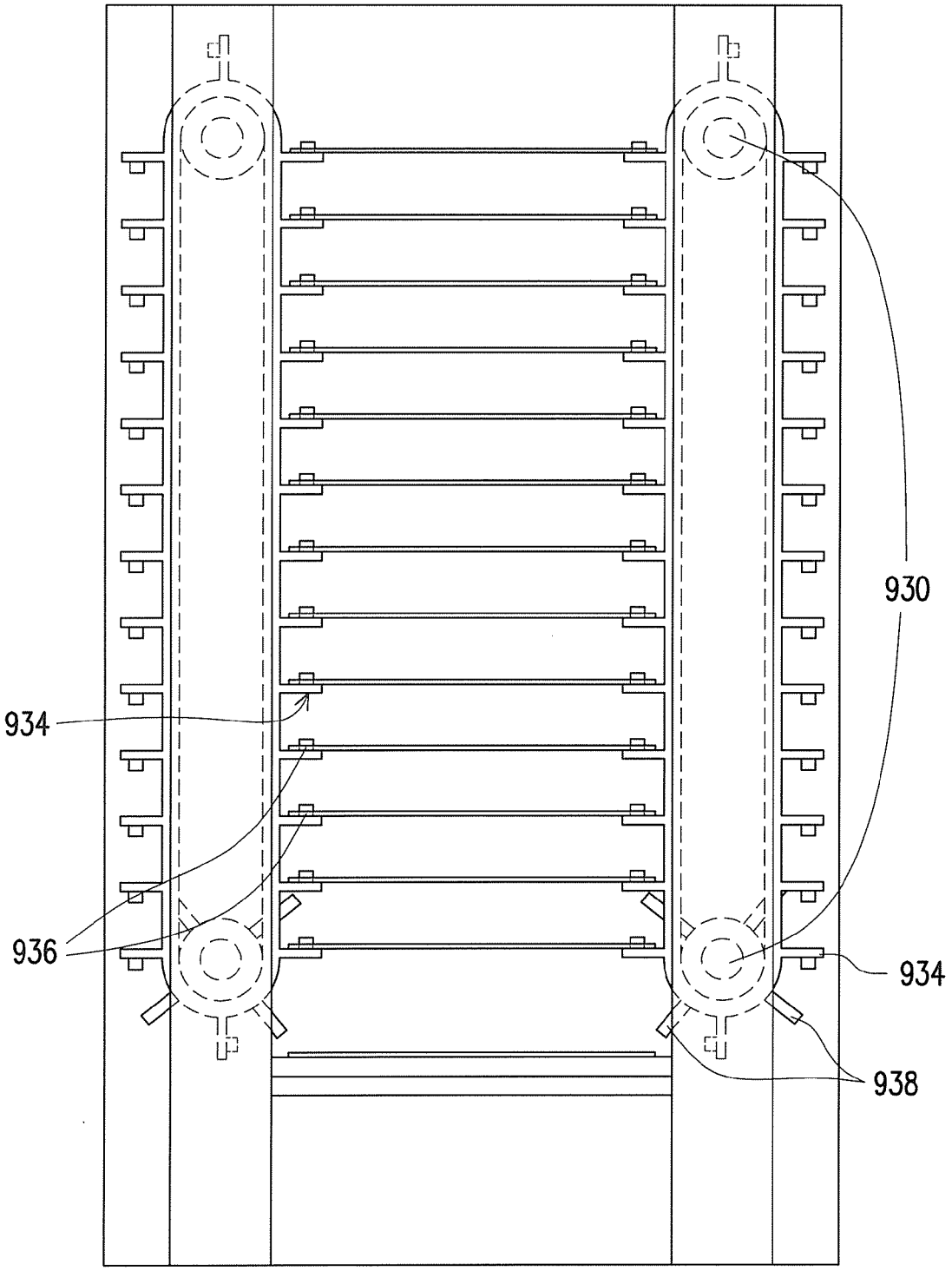
FIG. 10C is a front view of a chamber structure of FIG. 10A.
Figure 10D:
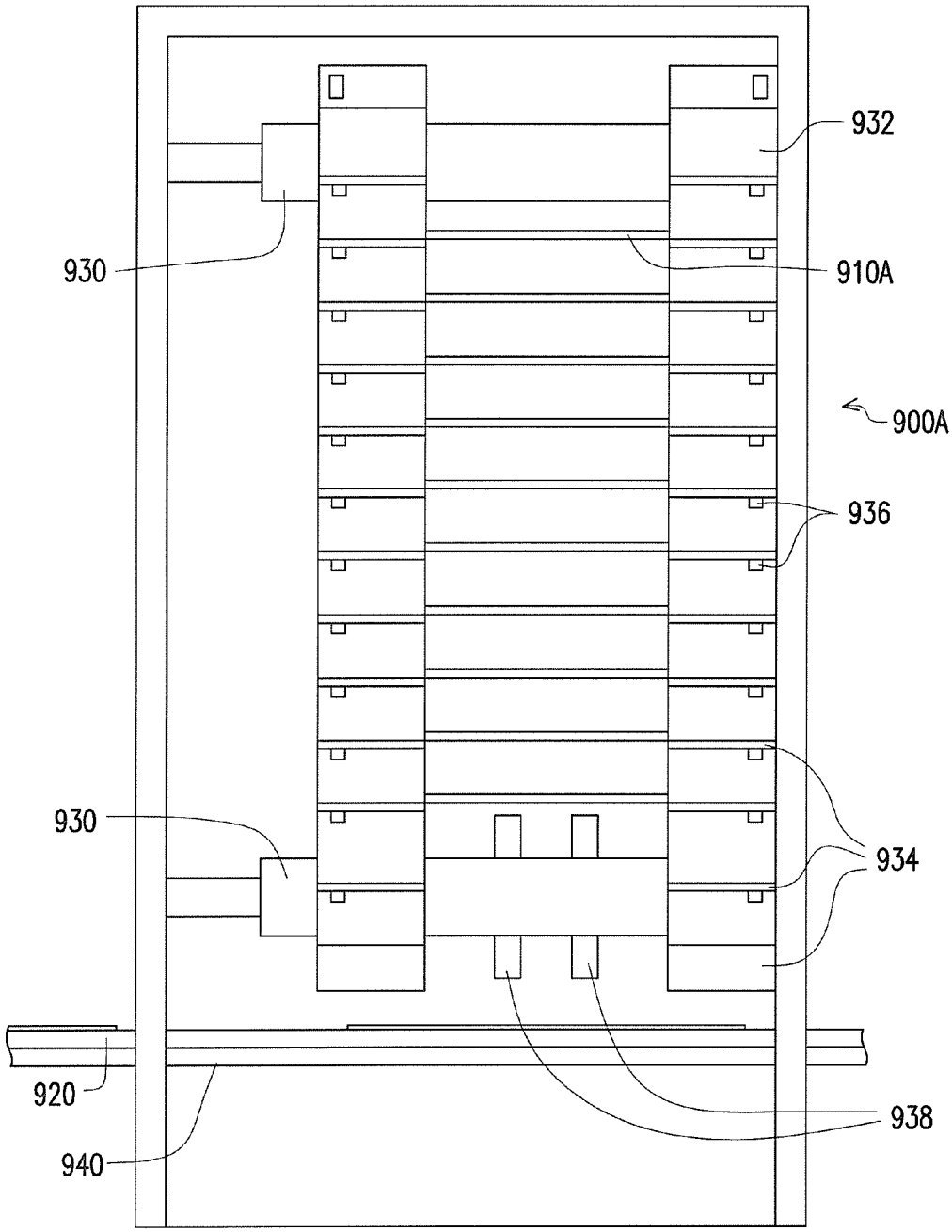
FIG. 10D is a side view of a chamber structure of FIG. 10A.

Referring to FIG. 10A and FIG. 10B, FIG. 10A and FIG. 10B are respectively a schematic diagram and a partial enlarged diagram illustrating a chamber structure according to another one of embodiments. FIG. 10C and FIG. 10D are respectively a front view and a side view of the chamber structure of FIG. 10A. In the embodiment, the components same to that in FIGS. 9A-9D are represented by the same reference numbers, and therefore detailed descriptions thereof are not repeated. The sheet elements 910A (for example, the sheet vibrating membranes or the sheet porous electrodes) has a plurality of through holes 912, and are suitable for being placed on the lower roll element 920 (for example, the roll porous electrode or the roll vibrating membrane). A plurality of support protrusion units 934 are configured on the transmission belt 932 for supporting the sheet elements 910A.

A plurality of buckles 936 are configured to the support protrusion units 934 on the transmission belt 932 of the chamber structure 900A, and the buckles 936 penetrate through the through holes 912 of the sheet elements 910A for buckling the sheet elements 910A, so as to provide extra tension to the sheet elements 910A. Since when the sheet vibrating membrane or the sheet porous electrode is placed on the lower roll porous electrode or the roll vibrating membrane, it has a certain degree of tension, so that it can be accurately combined without occurrence of distortion and deformation. The handle 938 can pull the sheet elements 910A, so that the sheet elements 910A can be smoothly separated from the support protrusion units 934 and the buckles 936.

It will be apparent to those skilled in the art that various modifications and variations can be made to the structure of the embodiment without departing from the scope or spirit of the embodiment. In view of the foregoing, it is intended that the embodiment cover modifications and variations of this embodiment provided they fall within the scope of the following claims and their equivalents.

What is claimed is:

1. A method for manufacturing a speaker, comprising:

providing a first roll element, and spreading the first roll element to be flat strip-shaped;

cutting the first roll element into a plurality of sheet elements, wherein each of the sheet elements is a vibrating membrane;

providing a second roll element, wherein the second roll element is a porous electrode having supporters;

providing an inserting device to insert the sheet elements into a temporary storage device;

spreading the second roll element to be flat strip-shaped;

providing an extracting device to extract the sheet elements from the temporary storage device;

placing the sheet elements on the flat strip-shaped second roll element; and combining the sheet elements with the second roll element to form a speaker unit wherein the step of providing the first roll element comprises:

forming a vibrating membrane layer, wherein the vibrating membrane layer comprises a vibrating membrane and metal layer formed on a surface of the vibrating membrane;

forming a frame structure having a plurality of grids on the metal layer of the vibrating membrane layer; and performing a charge-maintaining process to the vibrating membrane layer to maintain charges on the vibrating membrane, so as to form the first roll element.

2. The method for manufacturing the speaker as claimed in claim 1, wherein the temporary storage device carries the sheet elements in a vertical stacking mode, a horizontal layout mode or a linear arrangement mode.

3. The method for manufacturing the speaker as claimed in claim 1, wherein both of the inserting device and the extracting device hold the sheet elements through mechanical clamping, vacuum adsorption, static adsorption.

4. The method for manufacturing the speaker as claimed in claim 1, wherein the inserting device inserts the sheet elements in a sequential inserting mode.

5. The method for manufacturing the speaker as claimed in claim 1, wherein the inserting device extracts the sheet elements in a first-in-first-out mode according to an inserting order or in a sequential extracting mode.

6. The method for manufacturing the speaker as claimed in claim 1, wherein the sheet elements and the second roll element are combined through laminating or attaching.

7. The method for manufacturing the speaker as claimed in claim 1, wherein the temporary storage device is a chamber, a horizontal carrier having compartments, a horizontal transmission belt or a slide rail device.

8. The method for manufacturing the speaker as claimed in claim 1, wherein a material of the porous electrode is a transparent material.

9. The method for manufacturing the speaker as claimed in claim 1, wherein a material of the vibrating membrane is porous fluoride.

10. The method for manufacturing the speaker as claimed in claim 1, wherein a method of forming the metal layer comprises sputtering, plating or coating a metal material on the vibrating membrane, so as to form the metal layer.

11. The method for manufacturing the speaker as claimed in claim 1, wherein the frame structure is formed by arranging a plurality of the grids, so as to provide tension to the vibrating membrane layer.

12. The method for manufacturing the speaker as claimed in claim 1, wherein the step of performing the charge-maintaining process to the vibrating membrane layer comprises performing a ferroelectric process or a corona discharging process.

13. The method for manufacturing the speaker as claimed in claim 1, wherein the step of using the second roll-based manufacturing process to manufacture the second roll element comprises:

providing an electrode substrate;

forming a plurality of holes on the electrode substrate, so as to form a porous electrode;

disposing and bonding or adhering a plurality of supporters on the porous electrode at a region without the holes, so as to form the second roll element.

14. The method for manufacturing the speaker as claimed in claim 13, wherein a method of forming the holes on the electrode substrate comprises stamping, cutting or etching the electrode substrate to form the holes.

15. The method for manufacturing the speaker as claimed in claim 13, wherein a method of disposing the supporters on the on the porous electrode comprises using a vibrating mechanism or an alignment mechanism to dispose the supporters on a surface of the porous electrode.

16. The method for manufacturing the speaker as claimed in claim 13, wherein a method of bonding or adhering the supporters on the porous electrode comprises forming an adhesive material between the supporters and the porous electrode, and the adhesive material is cured by one of ultraviolet light, heat or pressure according to a characteristic of the adhesive material.

17. The method for manufacturing the speaker as claimed in claim 13, wherein the supporters are granular, square or hexagonal structures.

* * * * *